US005890427A

United States Patent [19]

Lindqvist

[11] Patent Number: 5,890,427

[45] Date of Patent: Apr. 6, 1999

[54] STAMPING PART OF A STAMP

[75] Inventor: Seppo Lindqvist, Vantaa, Finland

[73] Assignee: Leimasinteollisuus Oy, Helsinki, Finland

[21] Appl. No.: 860,076

[22] PCT Filed: Dec. 21, 1995

[86] PCT No.: PCT/FI95/00700

§ 371 Date: Aug. 28, 1997

§ 102(e) Date: Aug. 28, 1997

[87] PCT Pub. No.: WO96/20090

PCT Pub. Date: Jul. 4, 1996

[30] Foreign Application Priority Data

Dec. 23, 1994 [FI] Finland ..... 946068

[51] Int. Cl.[6] ..... B41J 1/60

[52] U.S. Cl. ..... 101/111; 101/109

[58] Field of Search ..... 101/111, 109, 101/105, 405, 406, 103

[56] References Cited

U.S. PATENT DOCUMENTS

| | | | |
|---|---|---|---|
| 2,428,378 | 10/1947 | Mossbach | 101/103 |
| 3,342,128 | 9/1967 | Weitzner | 101/103 |
| 3,380,378 | 4/1968 | Edwards et al. | 101/111 |
| 3,796,152 | 3/1974 | Finke et al. | 101/105 |
| 3,814,012 | 6/1974 | Derc | 101/111 |
| 4,038,918 | 8/1977 | Funahashi | 101/111 |
| 4,492,162 | 1/1985 | Nettesheim et al. | 101/405 |
| 4,561,353 | 12/1985 | Chapman et al. | 101/111 |
| 4,858,526 | 8/1989 | Bengtsson | 101/111 |

FOREIGN PATENT DOCUMENTS

| | | | |
|---|---|---|---|
| 593 443 | 2/1934 | Germany . | |
| 598 559 | 5/1934 | Germany . | |
| 593443 | 11/1934 | Germany | 101/111 |
| 2 742 053 | 4/1978 | Germany . | |
| 4 214 216 | 11/1993 | Germany . | |
| 2064435 | 6/1981 | United Kingdom | 101/111 |

*Primary Examiner*—Edgar Burr
*Assistant Examiner*—Anthony H. Nguyen
*Attorney, Agent, or Firm*—Helfgott & Karas, P C.

[57] ABSTRACT

Stamping part so fitted inside the casing (3) of a stamp that it is movable in the vertical direction, pressed by means of a know (4), which stamping part, to enable stamping, is provided with stamping pieces (10–12) placed in socket parts (19). The sockets are connected together in at least one endless band (16,17) by means of connecting lobes (20) between the foot ends of the sockets so that in connecting lobes and socket foot parts form a band. Moreover, the stamping part has a vertical framework (7,9) whose top and bottom ends are so rounded that the band can be revolved around said framework to select a desired stamp.

1 Claim, 3 Drawing Sheets

STAMPING PART OF A STAMP

The present invention relates to a stamping part for a stamp as defined in claim 1.

Since the beginning of the century, daters with revolvable bands have been used. The stamp has a casing and within it a movable stamping part provided e.g. with permanently coloured stamping pieces attached to its bottom. Stamping is performed by pressing a knob attached to the stamping part, which causes the stamping part to move downwards so that the stamping pieces come into contact with the paper or equivalent to be stamped. The date can be changed by changing the stamping pieces at the bottom of the stamping part. This is usually done by turning the band. The change pieces are generally kept in a separate box.

The object of the present invention is to improve the prior-art solution. In the stamping part of the invention, the stamping sockets are arranged in endless bands as presented in the characterization part of claim 1. Different embodiments of the invention are presented in the other claims.

With the stamping part of the invention, a very compact and practical stamp structure is achieved. The date can be changed very quickly by rotating the stamping pieces which, due to the band-like bottom, run along a track, so that the correct date is set in the stamp. Since the stamping pieces are stored in the stamp structure itself, there is no risk of their being lost.

In the following, the invention is described by the aid of an example by referring to the attached drawings, in which.

Figure 1:
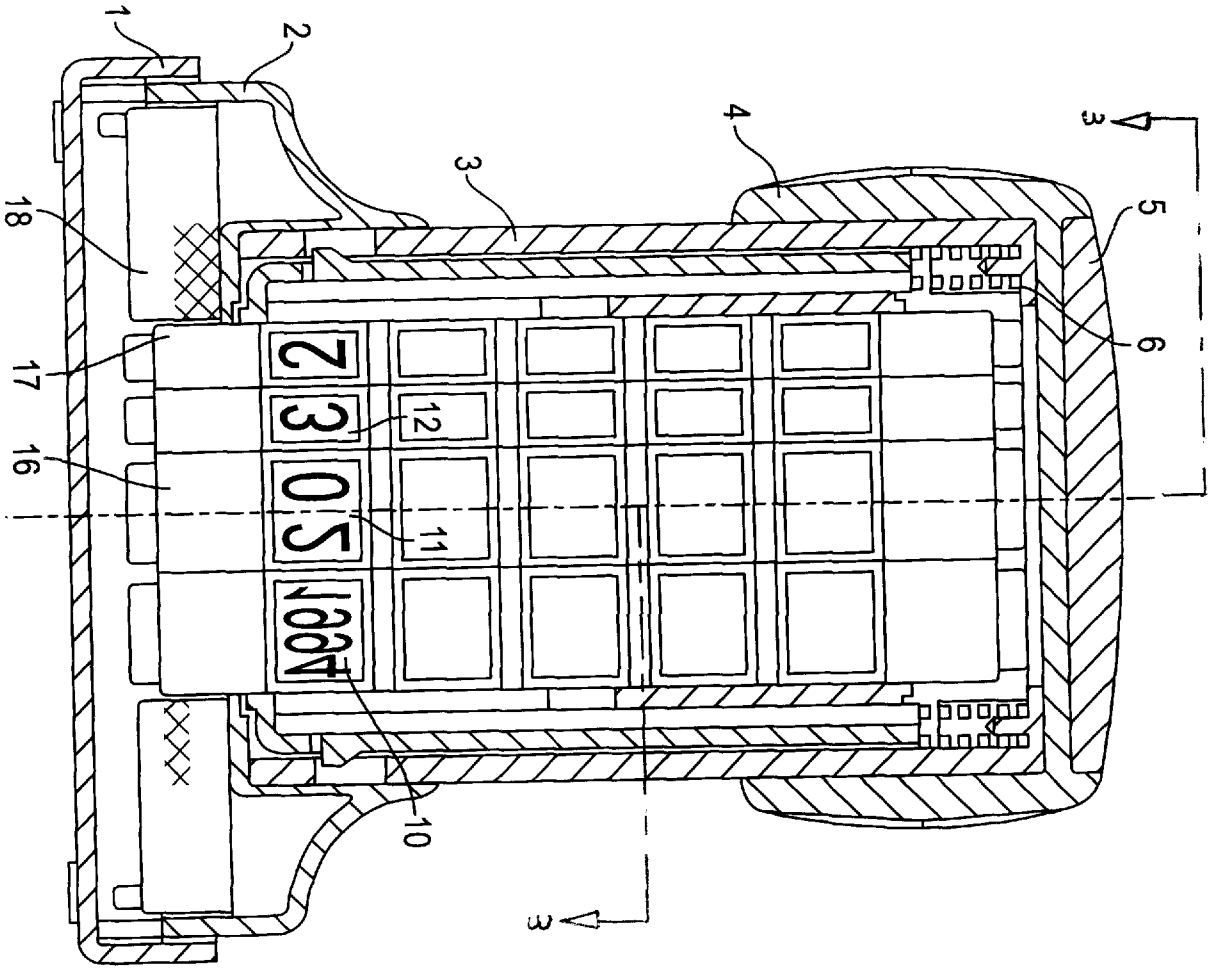

FIG. 1 presents a stamp as provided by the invention, with one end longitudinally sectioned.

Figure 2:
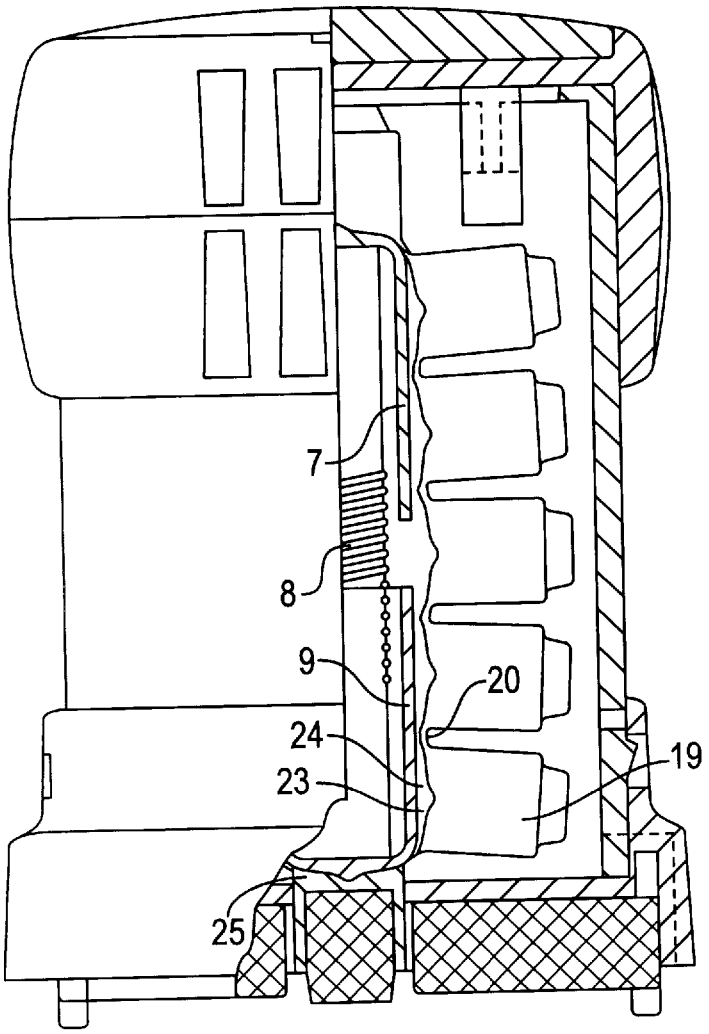

FIG. 2 presents a stamp as in FIG. 1 in a partially sectioned side view.

Figure 3:
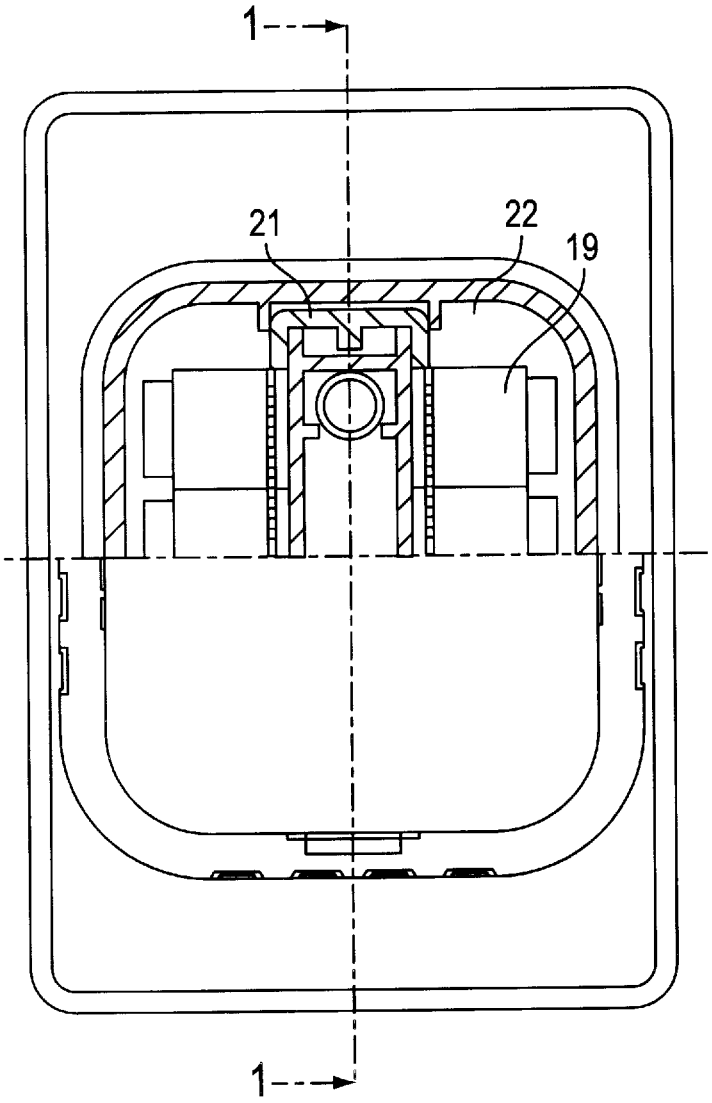

FIG. 3 presents a stamp as in FIG. 1 in top view along section A—A.

The date stamp presented in FIGS. 1–3 has a bottom 1, a frame 2 and a box-like casing 3 which is open at its top and bottom ends. For stamping, it has a stamping part which moves vertically inside the casing 3 and which is pressed down by means of a knob 4 to print a stamp. The top of the knob 4 is provided with a lens 5. The stamp is provided with springs 6 between the knob 4 and casing 3 to return the stamping part to its original position.

The stamping part has upper and lower flat spring elements 7, 9 forming a vertical framework and having a curvature at the upper and lower ends of said framework to allow a band-like stamping piece socket structure, which is to be described later on, to run around it. Between and within the spring elements 7, 9 are vertical springs 8, which allow vertical springing of the framework, thus facilitating the band movement.

As described above, the stamping pieces 10–12 (e.g. year plate 10, month plate 11 and two day plates 12) are fitted onto a plate band 16, 17 (e.g. four bands) revolved by means of a rotating mechanism (not shown) provided in the knob 4, the plate band being provided with plastic sockets 19 for the stamping pieces 10–12. In addition, a text plate 18 is provided beside the bands 16, 17 at the bottom end of the stamp.

Each one of the adjacent bands 16, 17 consists of a number of successive sockets 19 connected together at their foot ends by plastic connecting lobes 20. Thus, the endless, continuous band 16, 17 moving around the framework 7, 9 along an elliptic path is composed by the foot ends of the sockets 19 and the lobes 20. Thus, the date is changed by simply turning each band so that the correct date appears at the bottom of the stamp.

As can be seen from FIG. 3, the stamping part framework comprises vertical beams 21 which slide along slots 22 provided in the casing 3.

In the transverse direction, the bottom 23 of the foot part of the sockets 19, starting from the centre, slopes gently in the direction of the track in both directions, roughly corresponding to the rounded ends of the spring elements 7, 9. Moreover, the bottom 23 of the socket 19 is provided with a central transverse groove 24, which in turn corresponds to a narrow rib 25 provided at the centre of the upper and lower ends of the spring elements 7, 9, said ribs and grooves serving to centre the socket in the correct position at the lower end of the stamp.

It is obvious to a person skilled in the art that different embodiments of the invention are not restricted to the example described above, but that they may instead be varied in the scope of the following claims.

I claim:

1. A stamping part in a stamping device, the stamping device comprising a bottom, a frame, a casing which is open at its top and bottom ends, said stamping part movable vertically inside the casing, and a pressable knob to print a stamp;

said stamping part being provided with socket parts and permanently colored stamping pieces placed in said socket parts;

connecting lobes connecting said socket parts together in at least one endless band, said socket parts each having a foot part, the endless band being formed by the connecting lobes and the foot parts of the socket parts;

the stamping part comprising a vertical framework having top and bottom ends, said top and bottom ends being rounded so that the band can be revolved around said framework to select a desired stamp;

said framework including two parts placed one over the other, and a vertical spring, said vertical spring connecting said two parts together to facilitate band movement; and the bottom of each of said socket parts being provided with a transverse groove and at least the center of the lower end of the framework being provided with a corresponding transverse rib, said rib and said groove cooperating to center the socket in the correct position at the bottom of the stamp so as to permit stamping.

* * * * *